US008037834B2

(12) United States Patent
Shimizu et al.

(10) Patent No.: US 8,037,834 B2
(45) Date of Patent: Oct. 18, 2011

(54) SEWING MACHINE AND COMPUTER READABLE MEDIUM

(75) Inventors: Masaki Shimizu, Toyoake (JP); Hiroshi Yamasaki, Nagoya (JP); Hirokazu Hirose, Chiryu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 609 days.

(21) Appl. No.: 12/216,299

(22) Filed: Jul. 2, 2008

(65) Prior Publication Data

US 2009/0007829 A1 Jan. 8, 2009

(30) Foreign Application Priority Data

Jul. 3, 2007 (JP) ..... 2007-174943

(51) Int. Cl.
*D05B 19/00* (2006.01)

(52) U.S. Cl. ..... 112/470.03; 112/278; 112/470.04

(58) Field of Classification Search ..... 112/273, 112/278, 470.01, 470.03, 470.04
See application file for complete search history.

(56) References Cited

U.S. PATENT DOCUMENTS 6,450,110 B1 * 9/2002 Bruhl et al. ..... 112/470.01
6,470,813 B2 * 10/2002 Ebata et al. ..... 112/102.5
6,959,657 B1 * 11/2005 Duval ..... 112/272
7,325,502 B2 * 2/2008 Konig et al. ..... 112/470.03
2001/0050036 A1 * 12/2001 Ebata et al. ..... 112/102.5
2003/0131773 A1 * 7/2003 Schweizer ..... 112/102.5
2006/0213413 A1 * 9/2006 Koerner ..... 112/278
2007/0256619 A1 * 11/2007 Koemer ..... 112/470.05
2007/0272136 A1 11/2007 Shimizu
2008/0078313 A1 4/2008 Hamajima

FOREIGN PATENT DOCUMENTS

JP A-2002-292175 10/2002
JP A-2007-313159 12/2007
JP A-2008-79998 4/2008

OTHER PUBLICATIONS

U.S. Appl. No. 12/076,627, filed Mar. 20, 2008 in the name of Nakamura et al.

* cited by examiner

*Primary Examiner* — Nathan Durham
(74) *Attorney, Agent, or Firm* — Oliff & Berridge, PLC

(57) ABSTRACT

A sewing machine includes a sewing machine motor that vertically drives a sewing needle via a main shaft; a sewing speed commander that produces a command sewing speed determined by rotational speed of the sewing machine motor; a stitch-pitch specifier that specifies a stitch pitch to be applied to manually fed sewing operation; a consumed thread amount detector that detects a consumed needle-thread amount in each ongoing sewing cycle; a sewing speed controller that controls sewing speed at the command sewing speed when the command sewing speed is equal to or less than a predetermined reference sewing speed, and that controls sewing speed at a target sewing speed calculated based on the consumed needle-thread amount and the stitch pitch when the command sewing speed is greater than the reference sewing speed.

10 Claims, 10 Drawing Sheets

SEWING MACHINE AND COMPUTER READABLE MEDIUM

CROSS-REFERENCE TO RELATED APPLICATIONS

This application is based upon and claims the benefit of priority from the prior Japanese Patent Application 2007-174943, filed on Jul. 3, 2007, the entire contents of which are incorporated herein by reference.

FIELD

The present disclosure relates to a sewing machine that controls stitch pitches in manually fed quilting to be constant. The present disclosure also relates to a computer readable medium storing a sewing machine motor control program for use in the sewing machine to enable the above described control.

BACKGROUND

Conventionally, quilting have been performed with a sewing machine by stitching a three-layered fabric having materials such as cotton, feather, or urethane foam stuffed between the top cloth and the bottom cloth while forming decorative patterns on the top cloth of the fabric. The user is allowed to freely move the three-layered quilting fabric in given directions to enjoy quilting by combining various stitches such as straight stitches and curved stitches while the sewing machine is in operation.

For example, JP 2002-292175 A (hereinafter referred to as Reference 1) describes a sewing machine provided with a downwardly-oriented sensor mounted at a head of a sewing machine arm. Some of the images captured by the image sensor are inputted to a microcomputer provided in the sewing machine during the sewing operation and the inputted images are take in as static images at predetermined small time intervals. Then, amount of movement of the workpiece cloth is calculated by a first interrupt process. Then, a second interrupt process obtains speed of needle-bar movement, in other words, rotational speed of a sewing machine motor based on a preset "pitch-width" and the calculated amount of workpiece cloth movement. The sewing machine executes a sewing speed control so that the rotational speed of the sewing machine motor is altered from time to time to control the stitch pitch during manual feed so that spacing between the stitches is constant.

The sewing machine described in Reference 1 works fine when patterns can be sewn by effortlessly moving the workpiece such as quilting fabric manually by the user. However, when sewing patterns require dynamic manual movement of the workpiece, the workpiece need to be fed at lower speed. In such case, the needle bar is also moved at lower speed, consequently increasing the time period in which the workpiece is anchored in place by the sewing needle penetrating through it, which in turn reduces the time available for moving the workpiece.

When the user tries to force the movement of the workpiece with the sewing needle penetrating through it, the workpiece is pulled away from the sewing needle. Thus, once the sewing needle is lifted out of the workpiece, the workpiece becomes displaced by the sudden release of tension, resulting in displacement of stitches. The sudden movement of workpiece also causes sudden acceleration of needle-bar movement. When the user brings the workpiece movement to a sudden stop in response to the sudden workpiece movement and acceleration of the needle bar-movement, this time, needle-bar movement is suddenly decelerated.

Thus, when sewing patterns that require dynamic workpiece movement or when the user is a beginner at sewing machine operation, it is desirable to execute the sewing operation under low-speed needle-bar movement, in other words, under low-speed rotation of the sewing machine motor. However, when executing sewing operations at low speed with sewing machines that control sewing speed as described above, it is difficult to sew desired patterns in steady rhythm without stitch displacement.

SUMMARY

An object of the present disclosure is to allow smooth execution of free motion sewing with a sewing machine where workpiece such as quilting fabric is manually fed by the user.

In one aspect, a sewing machine of the present disclosure includes a sewing machine motor that vertically drives a sewing needle via a main shaft; a sewing speed commander that produces a command sewing speed determined by rotational speed of the sewing machine motor; a stitch-pitch specifier that specifies a stitch pitch to be applied to manually fed sewing operation; a consumed needle-thread amount detector that detects consumed needle-thread amount in each ongoing sewing cycle; a sewing speed controller that controls sewing speed at the command sewing speed when the command sewing speed is equal to or less than a predetermined reference sewing speed, and that controls sewing speed at a target sewing speed calculated based on the consumed needle-thread amount and the stitch pitch when the command sewing speed is greater than the reference sewing speed.

According to the above described configuration, in case free motion sewing speed, in other words, the command sewing speed is equal to or less than the predetermined reference sewing speed, the sewing machine motor is controlled at command sewing speed. Conventional sewing machines required the user to adjust the stitch pitch by the user him/herself when under slow command sewing speed in which case the workpiece cloth is anchored in place by the sewing needle for relatively longer period of time and the quilting fabric could only be fed intermittently. The sewing machine of the present exemplary embodiment allows the user to sew at the desired command sewing speed even under situations where the user was conventionally forced to adjust the stitch pitch by user him/herself. Thus, the user is able to smoothly execute free motion sewing at his own pace and rhythm.

In contrast, in case the command sewing speed is greater than the reference sewing speed, the target sewing speed is calculated based on the consumed needle-thread amount and the preset stitch-pitch, and the sewing machine motor is controlled at the target sewing speed. The user, enabled to smoothly feed the quilting fabric by the above described arrangement, is allowed to sew by adjusting the manual feed amount to the preset stitch-pitch. Thus, exquisite patterns with a neat constant stitch pitch can be readily formed by free motion sewing.

In another aspect, a sewing machine of the present disclosure includes a sewing machine motor that vertically drives a sewing needle via a main shaft; a sewing speed commander that produces a command sewing speed determined by rotational speed of the sewing machine motor; a stitch-pitch specifier that specifies a stitch pitch to be applied to manually fed sewing operation; a movement amount detector that detects a manually fed cloth movement amount; a sewing speed controller that controls sewing speed at the command sewing speed when the command sewing speed is equal to or less than a predetermined reference sewing speed, and that controls sewing speed at a target sewing speed calculated based on the cloth movement amount and the stitch pitch when the command sewing speed is greater than the reference sewing speed.

According to the above described configuration, in case the command sewing speed is equal to or less than the predetermined reference sewing speed, the user is allowed to sew at the command sewing speed even under situations where the user was conventionally forced to sew by adjusting the stitch pitch by user him/herself. Thus, the user is allowed to smoothly execute free motion sewing at his own pace and rhythm.

In contrast, in case the command sewing speed is greater than the reference sewing speed, the target sewing speed is calculated based on the cloth movement amount and the preset stitch-pitch, and the sewing machine motor is controlled at the target sewing speed. The user, enabled to smoothly feed the quilting fabric by the above described arrangement, is allowed to sew by adjusting the manual feed amount to the preset stitch-pitch. Thus, exquisite patterns with a neat constant stitch pitch can be readily formed by free motion sewing.

Yet in another aspect, a computer readable medium of the present disclosure for use in a sewing machine including a controller that controls the sewing machine, a sewing machine motor that vertically drives a sewing needle via a main shaft, a sewing speed commander that produces a command sewing speed determined by rotational speed of the sewing machine motor includes a sewing machine motor control program, comprising instructions for specifying a stitch pitch to be applied to manually fed sewing operation; instructions for detecting a consumed needle-thread amount in each ongoing sewing cycle; and instructions for controlling sewing speed at the command sewing speed when the command sewing speed is equal to or less than a predetermined reference sewing speed, and controlling sewing speed at a target sewing speed calculated based on the consumed needle-thread amount and the stitch pitch when the command sewing speed is greater than the reference sewing speed.

According to the above described configuration, the sewing machine control program stored in the medium, when executed by the controller of the sewing machine, provides the aforementioned effects.

Yet in another aspect, a computer readable medium of the present disclosure for use in a sewing machine including a controller that controls the sewing machine, a sewing machine motor that vertically drives a sewing needle via a main shaft, a sewing speed commander that produces a command sewing speed determined by rotational speed of the sewing machine motor includes a sewing machine motor control program, comprising instructions for specifying a stitch pitch to be applied in manually fed sewing operation; instructions for detecting a manually fed cloth movement amount; and instructions for controlling sewing speed at the command sewing speed when the command sewing speed is equal to or less than a predetermined reference sewing speed, and controlling sewing speed at a target sewing speed calculated based on the cloth movement amount and the stitch pitch when the command sewing speed is greater than the reference sewing speed.

According to the above described configuration, the sewing machine control program stored in the medium, when executed by the controller of the sewing machine, provides the aforementioned effects.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

Figure 1:
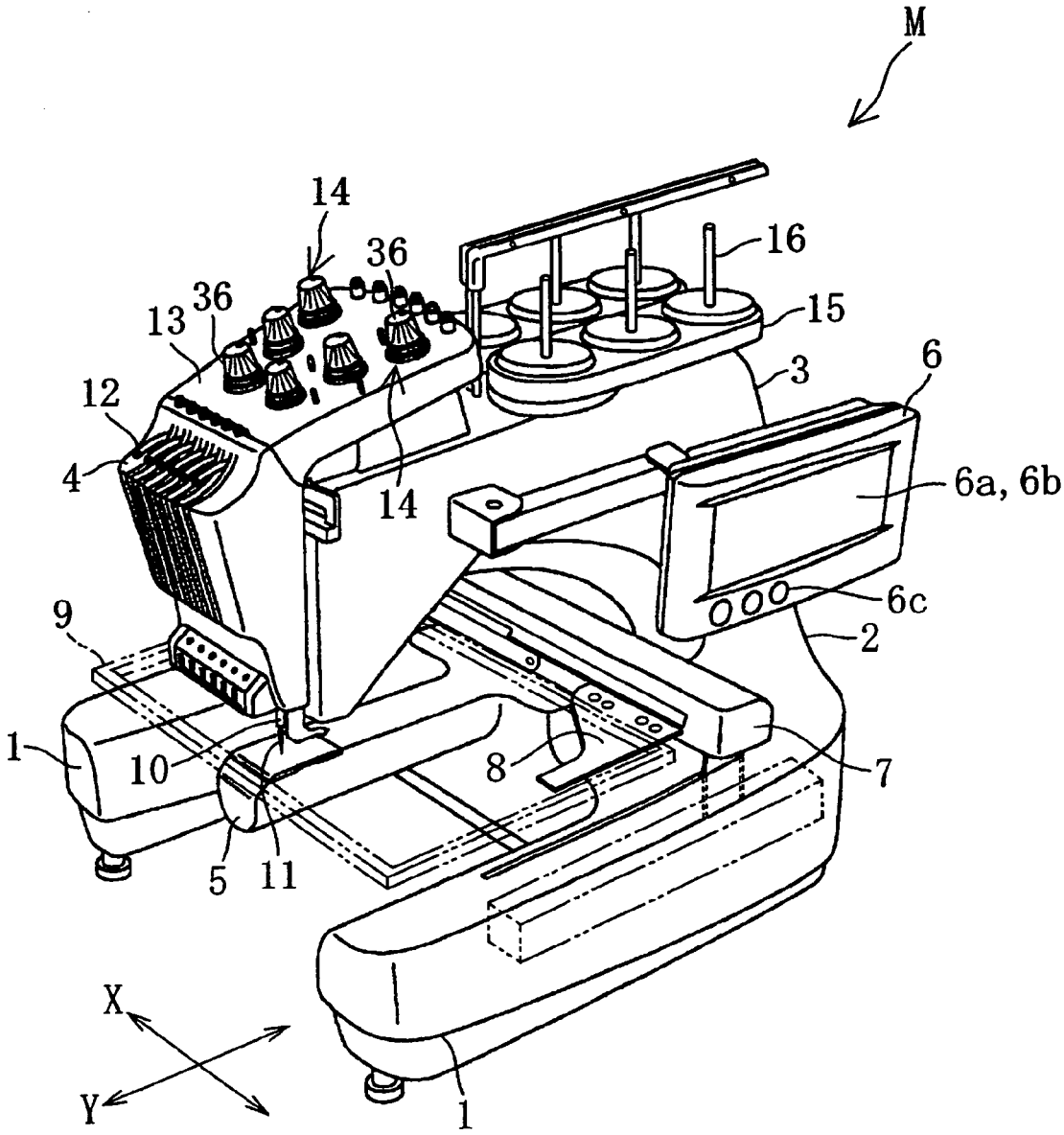
FIG. 1 is a perspective view of a multi-needle embroidery sewing machine.

Referring to FIG. 1, a multi-needle embroidery sewing machine M includes components such as a pair of left and right feet 1 that supports the entire sewing machine; a pillar 2 standing at the rear ends of feet 1; an arm 3 extending forward from the upper portion of pillar 2; a needle-bar case 4 attached on the front end of arm 3; a cylinder bed 5 extending forward from the lower end of pillar 2; and an operation panel 6.

Above feet 1, a carriage 7 is provided so as to be extended laterally. Carriage 7 contains an X-directional drive mechanism (not shown) driven by an X-axis drive motor 51 (refer to FIG. 4). The X-direction drive mechanism drives a frame mount 8 in the X-direction (lateral direction), frame mount 8 being provided integrally on the front side of carriage 7. The left and right feet 1 contain a Y-axis drive mechanisms (not shown) driven by a Y-axis drive motor 52 (refer to FIG. 4). The Y-axis drive mechanism drives carriage 7 in the Y-direction (longitudinal direction).

A workpiece cloth on which embroidery is formed is held by a rectangular embroidery frame 9 (cloth holding frame) indicated by double-dot chain line in FIG. 1. Embroidery frame 9 is mounted on frame mount 8. Frame mount 8 is moved in the X-direction by the X-direction drive mechanism. Carriage 7 is moved in the Y-direction by the Y-directional drive mechanism. Thus, embroidery frame 9 is moved in the Y-direction in synchronism with carriage 7 and in the X-direction with frame mount 8, to feed the workpiece cloth.

Figure 4:
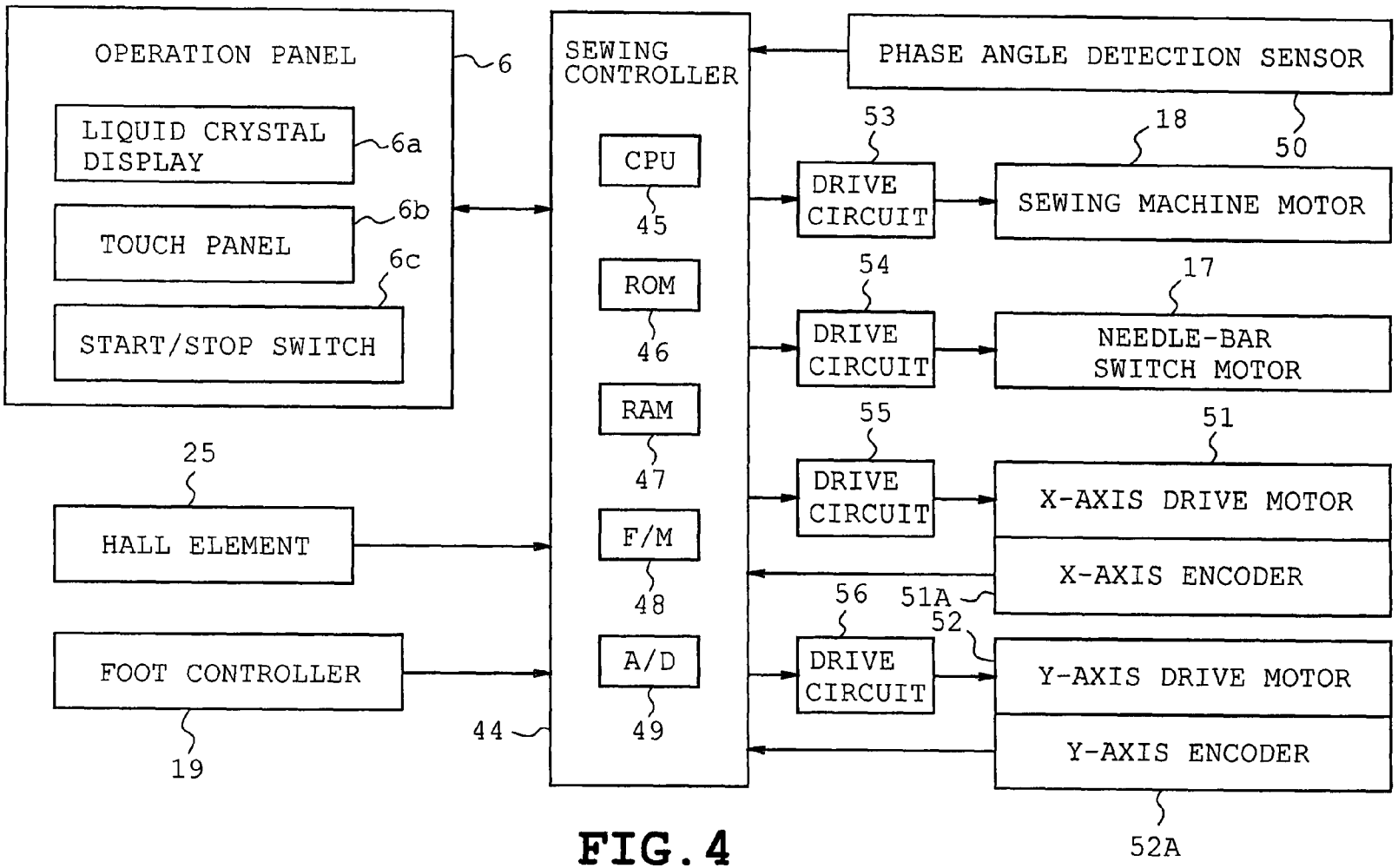
FIG. 4 is a block diagram of a control system of the multi-needle embroidery sewing machine.

X-axis drive motor 51 is provided with an X-axis encoder 51A (refer to FIG. 4). X-axis encoder 51A detects amount of displacement (displacement angle) of X-axis drive motor 51 in units of predetermined angles (0.5 degrees, for example). Similarly Y-axis drive motor 52 is provided with a Y-axis encoder 52A (refer to FIG. 4). Y-axis encoder 52A detects amount of displacement (displacement angle) of Y-axis drive motor 52 in units of predetermined angles (0.5 degrees, for example).

X-axis encoder 51A and Y-axis encoder 52A each comprise a disc and an optical detector. The disc is secured on the drive shafts of X-axis and Y-axis drive motors 51 and 52 respectively and is located on each drive shaft so as to be placed between a set of light-emitting element and a light-receiving element which constitute the optical detector. The disc has a plurality of radial slits aligned circumferentially at predetermined intervals. X-axis encoder 51A and Y-axis encoder 52A produce outputs of encoder signals based upon which a later described sewing controller 44 executes feedback control for monitoring X-directional and Y-directional movement amount of embroidery frame 9. In other words, X-axis encoder 51A and Y-axis encoder 52A serves as a sensor for detecting the amount of movement of workpiece cloth.

At the front end of arm 3, a needle bar case 4 is provided that contains six needle bars 10 arranged vertically movably, each needle bar 10 having a sewing needle 11 attached on its lower end. Needle-bar case 4 also has six vertically movable thread take-ups 12 corresponding to each needle bar 10. On the upper end of needle bar case 4, a thread tension base 13 made of synthetic resin is attached that is slightly inclined upward toward the rear. Thread tension base 13 has six thread tension regulators 14 that supply needle threads to each sewing needle 11.

Provided on the upper surface of the arm 3 is a thread dispenser 15 provided with six spool pins 16 for attachment of six thread spools (not shown) at maximum. The needle thread extending from each thread spool is threaded to the corresponding thread tension regulator 14 and thread take-up 12, and the like, and thereafter supplied to the eye of each sewing needle 11 mounted on the lower end of needle bar 10.

Provided inside arm 3 is a needle-bar selection mechanism (not shown) driven by a needle-bar switch motor 17 (refer to FIG. 4). When replacing the needle thread, needle-bar case 4 is laterally moved integrally with thread tension base 13 by the needle-bar selection mechanism driven by needle-bar switch motor 17 and one of the six needle bars 10 and the corresponding thread take-up 12 are selected and placed in a drive position.

Needle bar 10 and thread take-up 12 in the drive position are vertically driven in synchronism by a sewing machine motor 18 (refer to FIG. 4) to form embroidery stitches on the workpiece cloth in cooperation with a rotary shuttle (not shown) provided in the front end of cylinder bed 5. As described earlier, the workpiece cloth is retained by embroidery frame 9 situated above cylinder bed 5. Further, on the right side surface of arm 3, foldable operation panel 6 is provided which is configured as a touch panel.

As shown in FIG. 1, operation panel 6 is provided with a large, laterally elongate liquid crystal display 6*a*. Liquid crystal display 6*a* has a touch panel 6*b* provided on its surface. Touch panel 6*b* has a plurality of transparent touch keys that are associated with plurality types of pattern images and function names displayed on liquid crystal display 6*a*. Further, a start/stop switch 6*c* for instructing start and stop of sewing operation is provided below liquid crystal display 6*a* along with other switches.

When no embroidery patterns are being formed, the embroidery frame 9 provided immediately above the left and right pair of legs 1 is replaced by a laterally extending work table (not shown). The work table has a longitudinal slit defined at its lateral mid-portion having a width equivalent to the width of cylinder bed 5. The upper surface of the work table and the upper surface of the needle plate provided on the front end of cylinder bed 5 are coplanar. Thus, by placing the quilting fabric on the work table, the user is allowed to execute quilting in free motion.

In the present exemplary embodiment, multi-needle embroidery sewing machine M has a foot controller 19 connected to it through an analog port (not shown) provided at sewing controller 44. Foot controller 19, being placed on the floor, has a pedal (not shown) pivoted on it to be depressed by the user, and a variable resistor (volume or slider) that alters its resistance depending upon the amount of depression of the pedal by the user. Thus, foot controller 19 outputs voltage corresponding to the amount of user depression of the pedal, and the voltage is delivered to the analog port of sewing controller 44.

Next, a description will be given on thread tension regulator 14 and a rotation amount detection mechanism 40. A description will be given on only one of six thread tension regulators 14 since all six of them are identical in structure.

Figure 2:
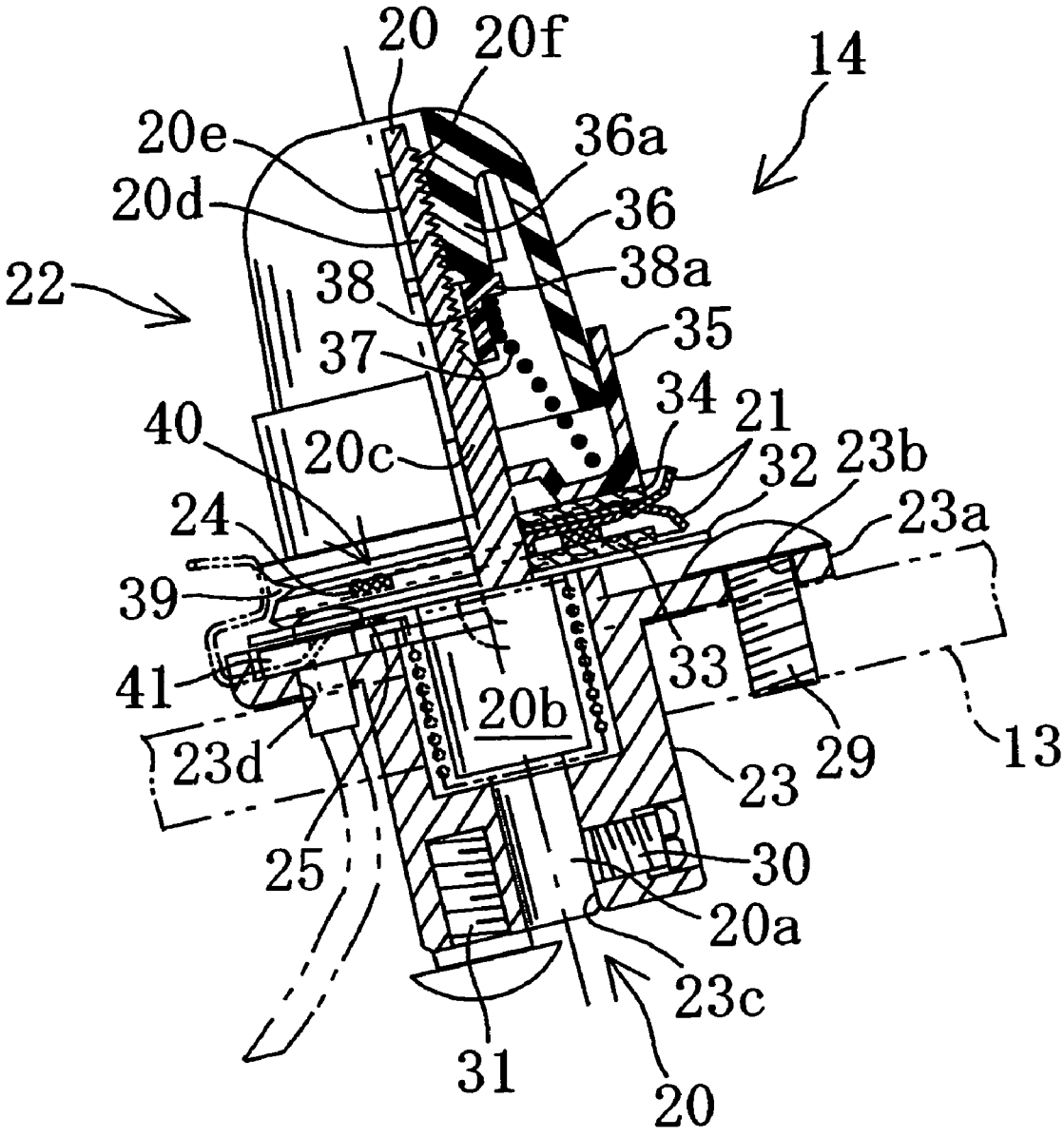
FIG. 2 is a vertical cross-sectional side view of a main portion of a thread tension regulator.
Figure 3:
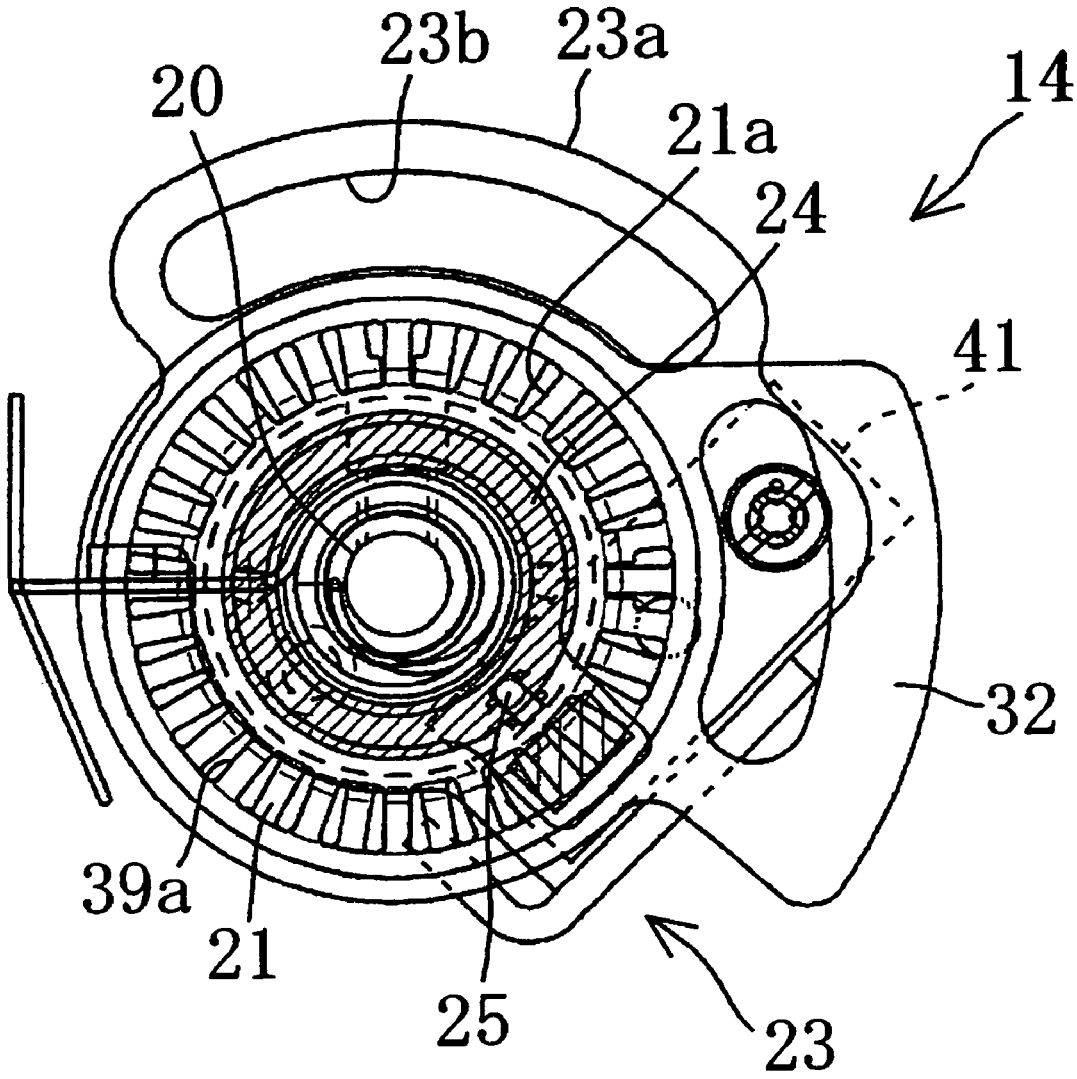
FIG. 3 is a vertical cross-sectional plan view of a main portion of a thread tension regulator.

Referring to FIGS. 2 and 3, thread tension regulator 14 includes components such as a shaft 20, rotary discs 21, an adjustment mechanism 22, a flanged body 23, permanent magnets 24, and Hall elements 25.

The diameter of shaft 20 varies depending on the axial location. As can be seen in FIG. 2, shaft 20 alters its diameter toward the top of FIG. 2 in listed sequence from a small-diameter section 20*a*, a large-diameter section 20*b*, a mid-diameter section 20*c* and a small-diameter section 20*d*. Small-diameter section 20*a* and large-diameter section 20*b* reside in body 23 made of metal. Body 23 is secured on thread tension base 13 by a screw 29 via a flange 23*a*.

Flange 23*a* has a circumferential long hole 23*b*, by which body 23, in other words, thread tension regulator 14 is repositionably screw fastened to thread tension base 13. Small-diameter section 20*a* of shaft 20 is tightly fitted into body 23 through hole 23*c* and secured integrally to body 23 by a fastening screw 30. Body 23 is also provided with a fastening screw 31 for earthing.

Shaft 20 has a groove 20*e* extending axially through out the entire length running from the terminating end of small-diameter section 20*d* to mid-diameter section 20*c*. Male thread 20*f* is defined on the outer-circumference of the small-diameter section 20*d* across approximately half the length running from the terminating end of small-diameter section 20*d* to mid-diameter section 20*c*. At the base end of mid-diameter section 20*c*, a washer 32 is fitted over shaft 20. At the base end of mid-diameter section 20*c* further toward small-diameter section 20*d*, an annular felt material 33, rotary discs 21 and an annular felt material 34 are fitted over shaft 20 so as to be integrally rotatable.

Adjustment mechanism 22 adjusts rotational resistance of rotary discs 21 and includes a rotary disc presser 35, an adjustment dial 36, a compression coil spring 37, and an annular spring receiver 38. Cylindrical rotary disc presser 35 made of synthetic resin material having an opened left end is fitted over the lower half of mid-diameter section 20*c* so as to be axially movable. The lower end of rotary disc presser 35 presses rotary discs 21 with a relatively small force via felt materials 33 and 34 that apply rotational resistance on rotary discs 21.

Adjustment dial 36 is made of synthetic resin and is generally tapered to exhibit a bell shape having an opened lower end. The lower end of adjustment dial 36 is fitted into rotary disc presser 35. On the upper-half interior of adjustment dial 36, a cylindrical portion 36*a* is formed that has a female thread defined on its inner circumference, allowing thread tension dial 36 to be fitted over shaft 20 by thread engagement of the female thread and male thread 20*f* of small-diameter section 20*d*.

Annular spring receiver 38 residing in the interior of adjustment dial 36 is fitted over small-diameter section 20*d* so as to be axially movable. The upper end of spring receiver 38 has a flange 38*a* having one end of compression coil spring 37 engaged with it. The other end of compression coil spring 37 is engaged with rotary disc presser 35. The bias of compression coil spring 37 places flange 38*a* of spring receiver 38 in abutment with cylindrical portion 36*a* residing in the interior of adjustment dial 36 while applying pressure on rotary discs 21 via rotary disc presser 35. Thus, by manually turning adjustment dial 36, spring receiver 38 is axially moved to effect adjustment of bias of compression coil spring, which in turn allows adjustment of pressure exerted on rotary disc presser 35. Adjustment is made on the rotational resistance of rotary discs 21 by the above described configuration.

Rotary discs 21 are composed of a pair of thin metal discs in back to back engagement with each other. On the outer circumference of rotary discs 21, a thread guide groove 39 having a substantially V-shaped cross section is defined to allow the needle thread to be wound one time (single winding). Rotary discs have at the proximity of the bottom of thread guide groove 39 a plurality of escape holes 21*a* that are defined at predetermined circumferential intervals. Escape holes 21*a* prevent slippage between the needle thread wound on thread guide groove 39 and rotary discs 21.

Next, a description will be given on a rotation amount detection mechanism 40.

Rotation amount detection mechanism 40 comprises permanent magnets 24 and Hall elements 25. Permanent magnets 24, being annular in form and having a diameter of approximately ½ of rotary discs 21, are approximately 2 to 3 mm thick. Permanent magnets 24 are mounted on the underside of the surface of rotary disc 21 which is orthogonal to the axis running through the center of rotary discs 21. Permanent magnets 24 are made of sintered metal and are disposed annularly such that N-poles and S-poles are situated alternately.

The magnetic field of permanent magnet 24 is oriented in the direction of its thickness (axial direction of thread tension regulator 14). Hall elements 25 are provided on a substrate secured on flange 23*a* of body 23. Thus, rotation of rotary discs 21 causes the direction of magnetic field projected to Hall elements 25 from permanent magnets 24 to switch over short period of time because of the alternating arrangement of N- and S-poles, thereby producing sinusoidal signals. The sinusoidal signals are shaped into waves by a wave-shaping circuit and thereafter converted into a rectangular wave-pulse ranging from "0" to "1".

When the sewing operation is started, rotary discs 21 are rotated by the movement of needle thread toward sewing needle 11. At this time, magnetic field directed from permanent magnets 24 to Hall elements 25 are altered to causes sinusoidal detection signals to be outputted from Hall elements 25. The pulse count obtained by the rectangular wave pulse based on the detection signal allows detection of consumed needle-thread amount.

Next, a description will be given on a control system of multi-needle sewing machine M.

Referring FIG. 4, sewing controller 44 comprises a microcomputer including components such as a CPU 45, a ROM 46, a RAM 47, a programmable non-volatile flash memory (F/M) 48, and an A/D converter (A/D) 49.

Sewing controller 44 further establishes connections with operation panel 6, six Hall elements 25 (only one Hall element 25 is shown) provided on each thread tension regulator 14, a foot controller 19, a phase angle sensor 50 that detects rotational phase angle of the main shaft, drive circuits 53, 54, 55, and 56 for sewing machine motor 18, needle-bar switch motor 17, X-axis drive motor 51, and Y-axis drive motor 52.

Sewing controller 44 receives encoder signals outputted from X-axis encoder 51A and Y-axis encoder 52A respectively. Sewing controller is further provided with the wave-shaping circuit (not shown) that shapes the waves of sinusoidal detection signals delivered from Hall elements 25, and a converter (not shown) for converting the wave-shaped detection signals into rectangular-wave pulse signals.

ROM 46 stores control programs that controls multi-needle sewing machine M to execute a free motion sewing control, and plurality types of data such as pattern data for execution of embroidery sewing. RAM 47 allocates memory for storing pattern data for embroidery patterns to be sewn, a stitch-pitch memory for storing the specified stitch-pitch, a consumed thread amount memory for storing incoming pulse signals from Hall elements 25 as count of consumed thread, and other various buffers, counters, memories, and the like, for temporary storage of calculation result produced CPU 45.

A/D converter 49 provided at sewing controller 44 converts voltage (analog signal) outputted to the analog port from foot controller 19 into a digital signal representing a command sewing speed. While foot controller 19 is connected to the analog port of sewing controller 44, a predetermined reference voltage is applied on the analog port. When foot controller 19 disconnected from sewing controller 44, 0V is applied to the analog port.

Next, a description will be given on a free motion sewing control executed by sewing controller 44 of multi-needle sewing machine M based on the flowchart indicated in FIG. 5. The reference symbol Si (i=11, 12, 13 . . . ) indicates each step of the control flow.

When power is supplied to multi-needle sewing machine M, a pattern group selection screen that displays multiple pattern groups is displayed on liquid crystal display 6*a* of operation panel 6. When a normal embroidery pattern is selected on the pattern group selection screen, sewing controller 44 starts an embroidery pattern sewing control not shown. On the other hand, when free motion is selected, a free motion mode is set and sewing controller 44 starts a free motion sewing control.

When the free motion mode is set, sewing controller 44 drives X-axis drive motor 51 and the Y-axis drive motor 52 by a predetermined amount and carriage 7 is moved towards the far side, in other words, the rearward direction to standby. Then, by setting the work table, the user is allowed to execute quilting on the work table. As the first step of free motion quilting, the user is required to specify a stitch pitch PD on operation panel 6 (S11).

At this instance, sewing controller 44 displays a stitch-pitch setting screen on liquid crystal display 6*a* of operation panel 6 and the user is allowed to specify the desired stitch pitch PD (2 mm, for example) by depressing touch keys with numerical labeling displayed on touch panel 6*b*. Sewing controller 44 stores stitch pitch PD specified at S11 in the stitch pitch memory allocated in RAM 47 as the stitch pitch to be applied in free motion quilting.

As the next step in the free motion sewing control, upon depression of foot controller 19 by the user to startup sewing machine motor 18 (S12: Yes), sewing controller 44 drives sewing machine motor 18 at a predetermined low-speed (100 rotations per minute (rpm), for example) (S13). Then, sewing controller 44 initializes stitch count NN of the stitch counter to "0" (S14) and executes sewing speed control (refer to FIG. 6) (S15).

As the first step of the sewing speed control, sewing controller 44 obtains the phase angle of the main shaft based on an incoming phase angle signal delivered from phase angle sensor 50. If the detected phase angle does not indicate a predetermined phase angle ("115 degrees", for example) in which sewing needle 11 strikes the quilting fabric (S21: No), the control is terminated immediately. However, if sewing needle 11 strikes the quilting fabric and the detected phase angle indicates "115 degrees" (S21: Yes), stitch count NN is incremented by one (S22).

Next, sewing controller 44 reads the incoming command sewing speed from foot controller 19 (S23) and determines whether or not it is equal to or less than a predetermined reference sewing speed (200 rpm, for example). If the user desires to proceed patiently with free motion sewing, the user may relax the depression of the pedal to decelerate the outgoing command sewing speed from foot controller 19. If the decelerated command sewing speed, being read by sewing controller 44 is equal to or less than the predetermined reference sewing speed (S24: Yes), sewing controller 44 controls sewing machine motor 18 at the command sewing speed (S33). Then, sewing controller 44 clears the consumed thread amount stored in consumed thread amount memory allocated in RAM 47 (S32) and terminates the control.

In contrast, in case the command sewing speed, being read by sewing controller 44, is greater than the reference sewing speed (S24: No), sewing controller 44 reads the consumed thread count stored in the consumed thread amount memory allocated in RAM 47 (S25). Then, sewing controller 44 calculates the consumed needle-thread amount, in other words, the movement amount of quilting fabric based on the consumed thread count read (S26). More specifically, sewing controller 44 multiplies a thread amount corresponding to a single pulse signal delivered from Hall elements 25 by consumed thread count in order to obtain the consumed needle-thread amount, based upon which the current cloth movement amount is calculated.

Next, sewing controller 44 calculates the current sewing speed of sewing machine motor 18 based on the count of incoming phase angle signals from phase angle sensor 50 at predetermined small time intervals (S27). Then, sewing controller 44 calculates a target sewing speed under which sewing machine motor 18 is to be driven in order to provide the desired stitch pitch PD (S28). More specifically, sewing controller 44 multiplies the actual cloth movement amount obtained at S26 by the current sewing speed calculated in S27. The product is divided by stitch pitch PD specified at S11 to calculate the target sewing speed. If the target sewing speed is equal to or less than the reference sewing speed (S29: Yes), sewing controller 44 applies the reference sewing speed as the target sewing speed (S30). Then, sewing controller 44 controls sewing machine motor 18 at the target sewing speed (S31). Then, after S32, sewing controller 44 terminates the control and returns to S16 of the free motion sewing control (refer to FIG. 5). As described above, sewing controller 44 controls the sewing speed determined based on the rotational speed of sewing machine motor 18 while maintaining the target sewing speed to be greater than the reference sewing speed.

In contrast, in case the target sewing speed is greater than the reference sewing speed (S29: No), sewing controller 44 skips S30 and executes steps S31 and S32. Since sewing machine motor 18 is controlled at the target sewing speed which is arranged to exceed the reference sewing speed, the user is allowed to execute the sewing operation under the specified stitch pitch PD.

After returning to step S16 of free motion sewing control, sewing controller 44 executes consumed thread amount calculation process for calculating (detecting) the consumed needle-thread amount in each sewing cycle. That is, within the period when feeding is allowed in each sewing cycle, sewing controller 44 increments consumed thread count every time a pulse signal is inputted from Hall elements 25. Thus, sewing controller 44 is able to calculate consumed needle-thread amount in each sewing cycle. Sewing controller 44 stores the consumed thread count in the consumed thread amount memory allocated in RAM 47.

While foot controller 19 is being depressed (S17: Yes), sewing controller 44 repeats S15 to S17. When foot controller 19 is no longer depressed and sewing machine motor 18 is stopped (S17: No) due to completion of free motion sewing, sewing controller 44 terminates the control.

Next, a description will be given on the operation of free motion sewing executed by multi-needle embroidery sewing machine M.

In executing free motion quilting that allows the user to freely move the quilting fabric, first, the user is required to set a desired stitch pitch PD ("2 mm", for example) on operation panel 6. Then, quilting is started when foot controller 19 is depressed to obtain the desired command sewing speed (150 rpm, for example).

For instance, in case the preset reference sewing speed is 200 rpm, the command sewing speed of "150 rpm" provided by foot controller 19 at the beginning of quilting falls under the range of being equal to or less than the reference sewing speed. Thus, sewing machine motor 18 is controlled at the command sewing speed of "150 rpm" and not the target sewing speed.

As described above, when the command sewing speed provided by foot controller 19 is equal to or less than the predetermined reference sewing speed, sewing machine motor 18 is controlled at the command sewing speed. Conventional sewing machines required the user to adjust the stitch pitch by user him/herself when under slow command sewing speed in which case the quilting fabric could only be fed intermittently. Multi-needle embroidery sewing machine M of the present exemplary embodiment, on the other hand, allows the user to sew at the desired command sewing speed even under situations where the user was conventionally forced to sew by adjusting the stitch pitch by the user him/herself. Thus, the user is allowed to smoothly execute free motion sewing at his own pace and rhythm.

In contrast, in case the command sewing speed is greater than the reference sewing speed, the target sewing speed is calculated based on the consumed needle-thread amount, the preset stitch-pitch and the current sewing speed, and sewing machine motor 18 is controlled at the target sewing speed. Since the user is able to feed the quilting fabric smoothly, the user is allowed to sew by adjusting the cloth feed amount to the preset stitch-pitch. Thus, exquisite patterns with a neat constant stitch pitch can be readily formed by free motion sewing.

In case the target sewing speed is equal to or less than the reference sewing speed, sewing machine motor 18 is controlled at the reference sewing speed. In case the target sewing speed is greater than the reference sewing speed, sewing machine motor 18 is controlled at the target sewing speed. Since quilting fabric can be manually fed smoothly even when the target sewing speed is less than the reference sewing speed, let alone when the target sewing speed is greater than the reference sewing speed, free motion quilting can be executed with more ease.

Next, partial modifications of the above described exemplary embodiment will be described hereinafter. First, a description will be given on a first modified exemplary embodiment.

In free motion sewing control, when the command sewing speed is equal to or greater than the reference sewing speed and equal to or less than a speed which is greater than the reference sewing speed by a predetermined speed, sewing controller 44 may correct the sewing speed to proximate the target sewing speed.

Figure 5:
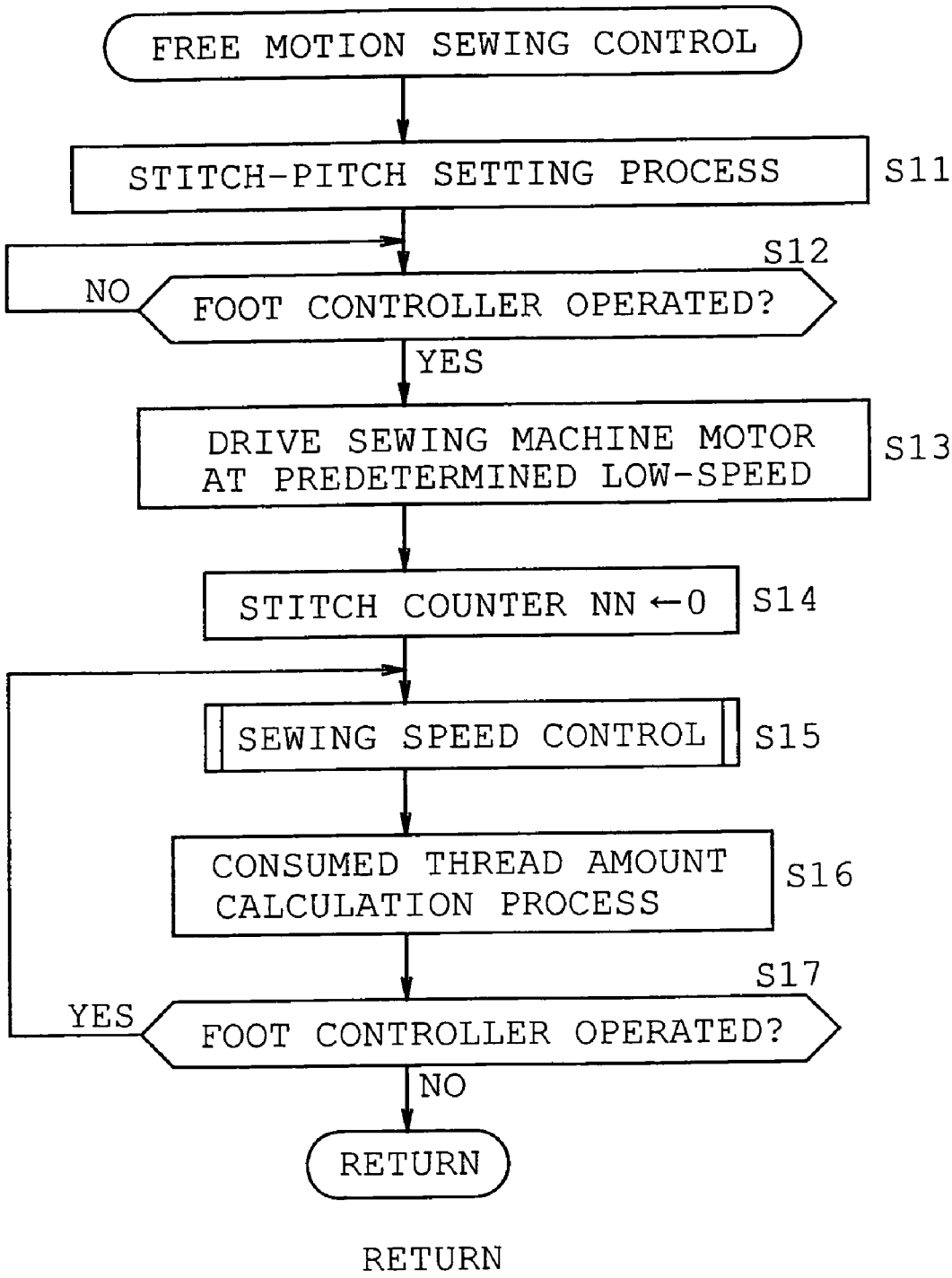
FIG. 5 is a flowchart of a free motion sewing control.
Figure 6:
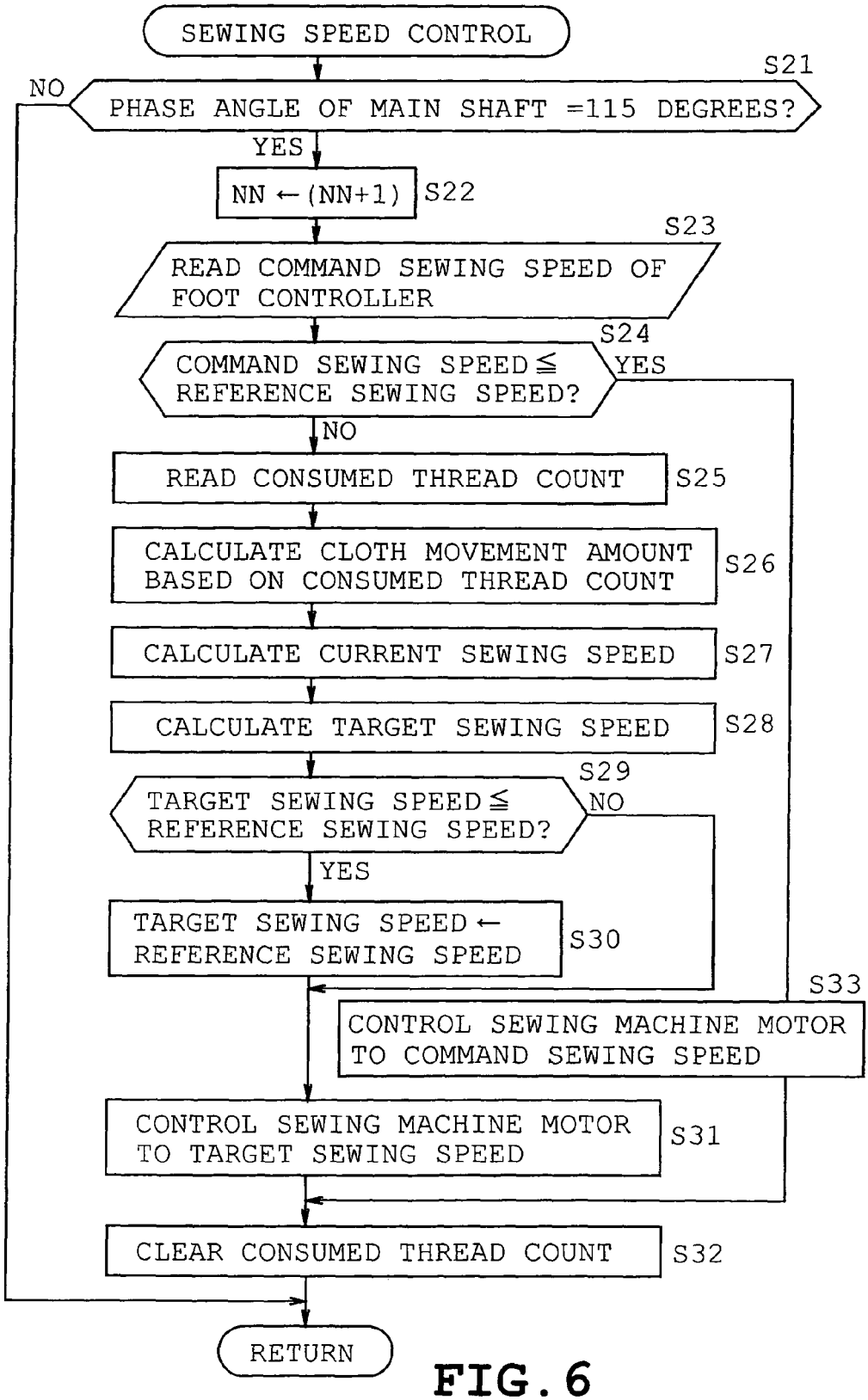
FIG. 6 is a flowchart of a sewing speed control.
Figure 7:
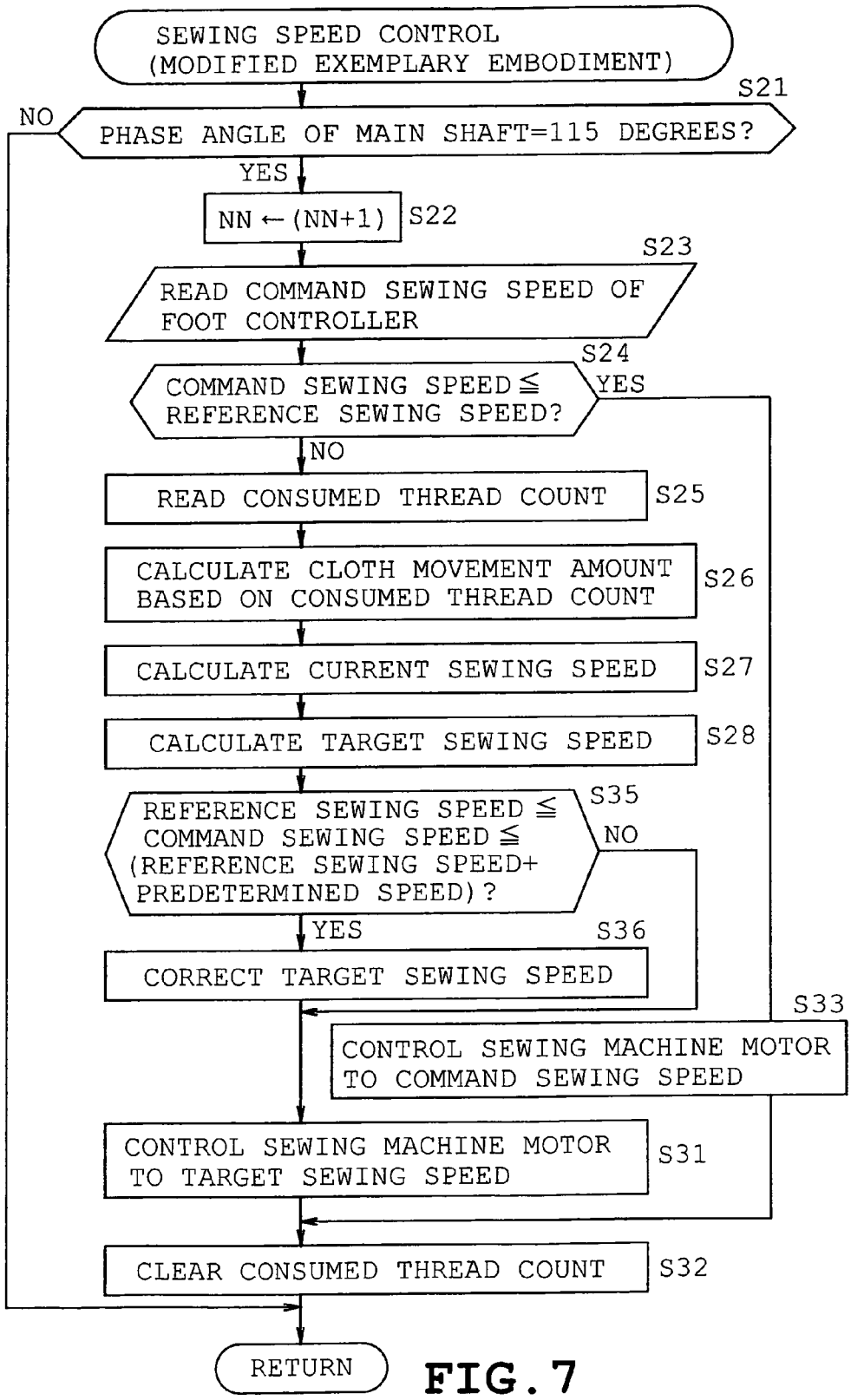
FIG. 7 is a modified exemplary embodiment of FIG. 6.

More specifically, at step S15 of free motion sewing control indicated in FIG. 5, sewing controller 44 may execute the sewing speed control indicated in FIG. 7 instead of the sewing speed control indicated in FIG. 6. Steps S21 to S28 of FIG. 7 being identical to steps S21 to S28 of FIG. 6, will not be described. Then, at S35, if a command sewing speed Vs read at S23 is equal to or greater than a reference sewing speed Vk and equal to or less than a speed Ve which is the sum of reference sewing speed Vk and corrective speed range ΔV (predetermined speed) (S35: Yes), sewing controller 44 executes corrective calculation of target sewing speed Vm (S36).

In other words, sewing controller 44 executes corrective calculation of target sewing speed Vm according to the following equation.

$$Vm \leftarrow Vs + (Vm - Vs) \times \{(Vs - Vk)/\Delta V\}$$

Vm: target sewing speed

Vs: command sewing speed

Vk: reference sewing speed

ΔV: corrective speed range

Figure 8:
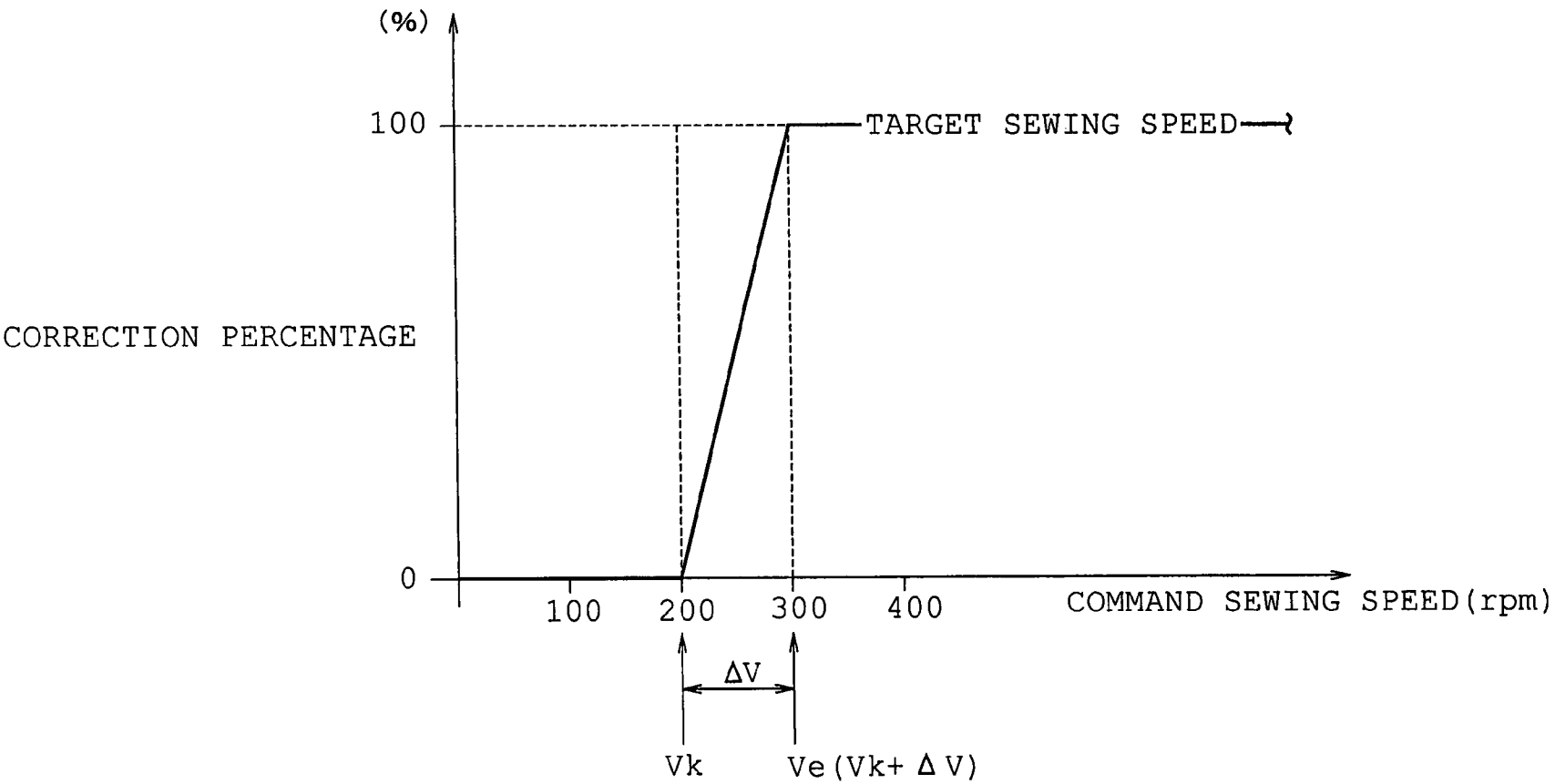
FIG. 8 describes a correction percentage in correcting a target sewing speed.

Referring to FIG. 8, the latter half of the equation "(Vs−Vk/ΔV)" indicates percentage of correction (%) of target sewing speed Vm, and the greater the magnitude of command sewing speed Vs in excess of reference sewing speed Vk, the greater the percentage of correction of target sewing speed Vm. When correction percentage is "100%", target sewing speed Vm remains intact without any corrections.

Based on target sewing speed Vm thus calculated, sewing controller 44 executes S31 to S32 as described in the previous exemplary embodiment to control the speed of sewing machine motor 18. That is, the current sewing speed is not modified at large scale but at a small and smooth scale in accordance with the magnitude of command sewing speed Vs in excess of reference sewing speed Vk.

As described above, in case command sewing speed Vs is equal to or greater than reference sewing speed Vk and equal to or less than speed Ve which is greater than reference sewing speed Vk by a corrective speed range ΔV (predetermined speed), sewing controller 44 corrects the sewing speed to proximate target sewing speed Vm as the magnitude of command sewing speed Vs in excess of reference sewing speed Vk increases. Thus, by gradually accelerating or decelerating the sewing speed depending on the magnitude of the command sewing speed, the user is allowed to smoothly execute free motion sewing.

Figure 9:
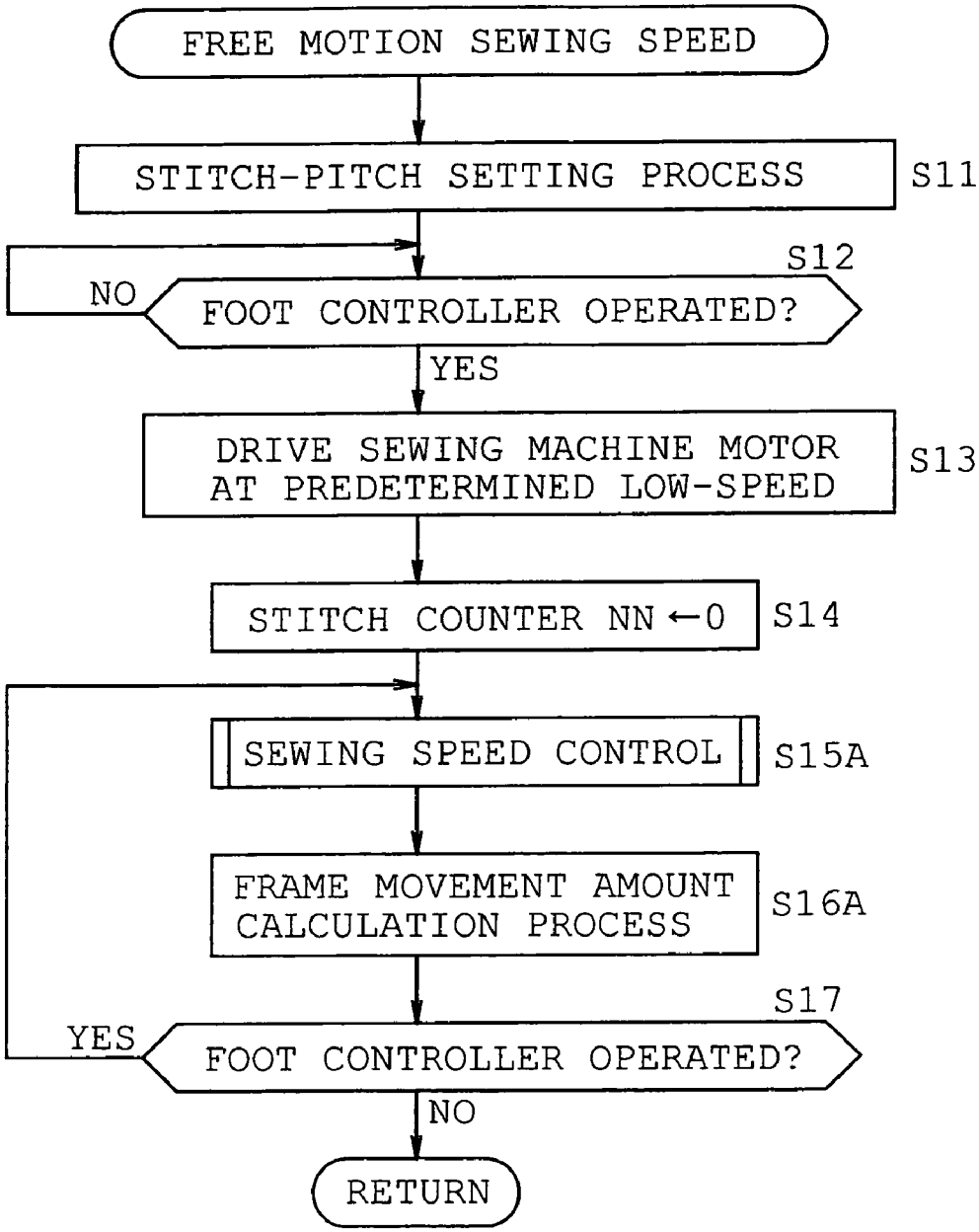
FIG. 9 is a modified exemplary embodiment of FIG. 5.

Next a description will be given on a second modified exemplary embodiment. In free motion sewing control, the movement amount of quilting fabric being calculated based on the consumed needle-thread amount may be partially modified as indicated in FIG. 9. In this case, embroidery frame 9 holding the quilting fabric and being attached to frame mount 8 by the user is moved manually. The movement amount of embroidery frame 9 is detected by X-axis encoder 51A provided at X-axis drive motor 51 and Y-axis encoder 52A provided at Y-axis drive motor 52. Sewing controller 44 calculates the cloth movement amount based on the detected movement amount of embroidery frame 9. Of note is that X-axis drive motor 51 and Y-axis drive motor 52 are not to be excited.

Figure 10:
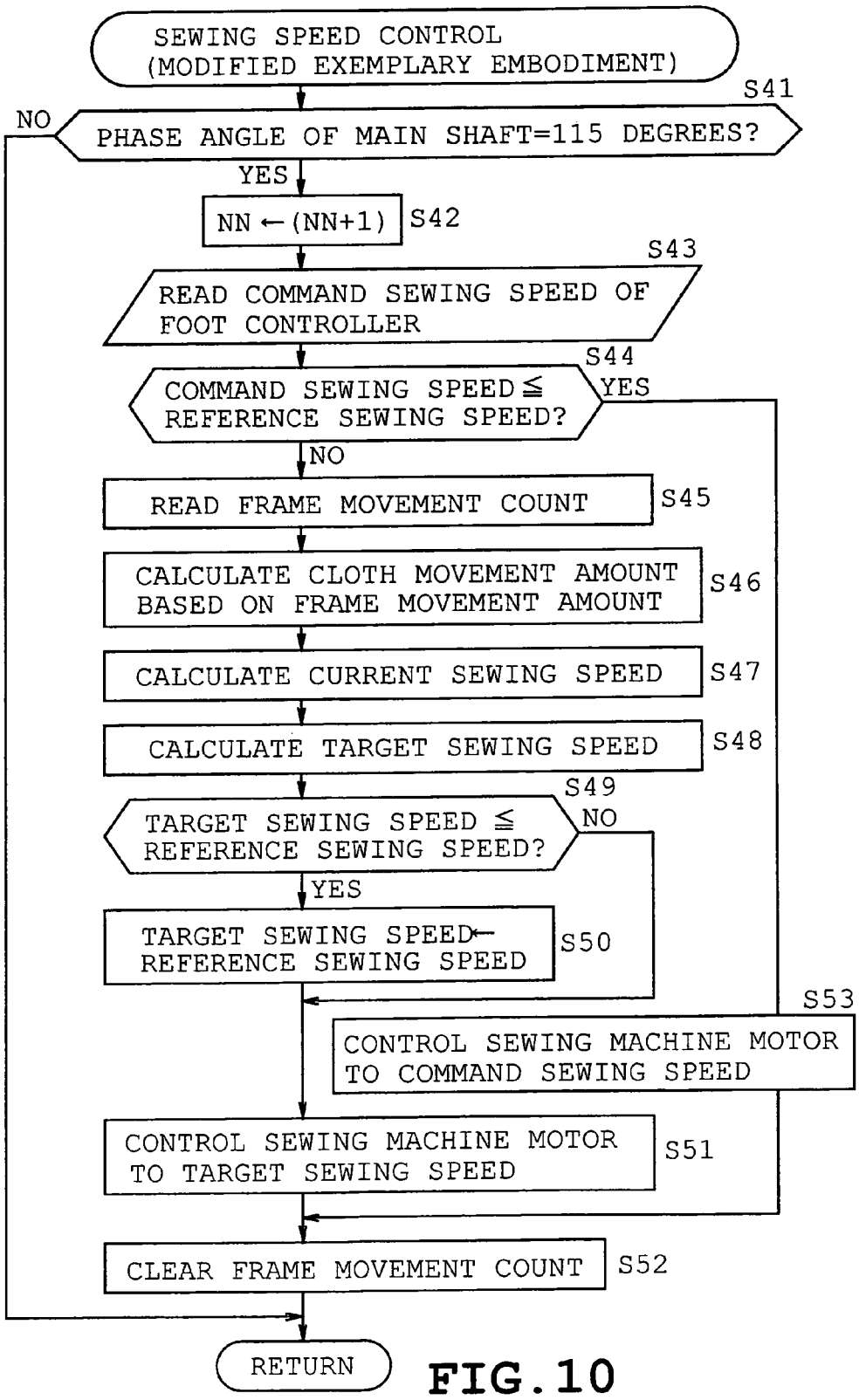
FIG. 10 is a modified exemplary embodiment of FIG. 6.

A description will be given hereinafter on the free motion sewing control indicated in FIG. 9 for portions that differ from the control indicated in FIG. 5. Sewing controller 44, after initializing needle count NN at S14, executes a sewing speed control (refer to FIG. 10) later described at S15A. Then, at S16A, sewing controller 44 executes the frame movement amount calculation process for calculating the movement amount of embroidery frame 9. A detailed description will first be given on the frame movement amount calculation process.

During the period in which feeding is allowed in each sewing cycle, sewing controller 44 increments an X-directional count every time an encoder signal is inputted from X-axis encoder 51A, while similarly incrementing a Y-directional count every time an encoder signal is inputted from Y-axis encoder 52A. Sewing controller 44 thus calculates the frame movement amount in each sewing cycle. Sewing controller 44 stores the X- and Y-directional counts in the cloth movement amount memory allocated in RAM 47.

Next, a description will be given on the sewing speed control executed at S15A. As the first step of this control, sewing controller 44 executes S41-S43 indicated in FIG. 10 as done at S21 to S23 in the sewing speed control executed in FIG. 6. If the command sewing speed is greater than the predetermined reference sewing speed (S44: No), sewing controller 44 reads the count of frame movement amount, that is, the X- and Y-counts stored in the cloth movement amount memory allocated in RAM 47 (S45), based upon which cloth movement amount of quilting fabric is calculated (S46).

More specifically, sewing controller 44 multiplies the frame movement amount corresponding to a single incoming encoder signal from X-axis encoder 51A by the X-directional count to calculate the X-directional movement amount. Likewise, sewing controller 44 multiplies the frame movement amount corresponding to a single incoming encoder signal from Y-axis encoder 52A by the Y-directional count to calculate the Y-directional movement amount. Based on the X-directional movement amount and the Y-directional movement amount, sewing controller 44 calculates the current cloth movement amount.

Sewing controller 44 executes subsequent S47 to S53 as done in S27 to S33 of sewing speed control indicated in FIG. 6. Of note is that at S52, sewing controller 44 clears the frame movement count (X-directional count and Y-directional count) stored in the cloth movement amount memory allocated in RAM 47.

In case the command sewing speed provided by foot controller 19 is equal to or less than the predetermined reference sewing speed, the sewing machine motor 18 is controlled at the command sewing speed. Thus, even if the user is required to adjust the stitch pitch him/herself when command sewing speed is relatively slow and quilting cloth can only be fed intermittently, the user is allowed to sew at the desired command sewing speed. Thus, the user is allowed to smoothly execute free motion sewing at his own pace and rhythm.

In contrast, in case the command sewing speed is greater than the reference sewing speed, the target sewing speed is calculated based on the movement amount of quilting fabric, the preset stitch pitch and the current sewing speed, and sewing machine motor 18 is controlled at the target sewing speed. Since the user is able to feed the quilting fabric smoothly, the user is allowed to sew by adjusting the cloth feed amount to the preset stitch-pitch. Thus, exquisite patterns with a neat constant stitch pitch can be readily formed by free motion sewing.

Further, since the movement amount of embroidery frame 9 holding the quilting fabric is detected by X-axis encoder 51A and Y-axis encoder 52A, the movement amount of quilting fabric can be obtained readily and accurately.

The cloth holder for holding the workpiece cloth is not limited to frame-form but may be configured as a plate-form element (plate element), for example. In such case, the plate element may be mounted on carriage 7 so as to be movable in the X-direction and the workpiece cloth may be held by the plate element by simply being placed on it. Alternatively, the workpiece cloth may be placed on a platform element and moved integrally with it, so that its amount of movement may be detected by detecting the amount of movement of the platform element.

A description will be given on a third modified exemplary embodiment. Reference sewing speed Vk and corrective speed range ΔV described in the first modified exemplary embodiment may be specified at a given value by the user through operation panel 6.

A description will now be given on a fourth modified exemplary embodiment. The movement amount of quilting fabric may be detected by non-contact sensors such as CCD (Charge Coupled Device) image sensors and CMOS (Complimentary Metal Oxide Semiconductor) image sensors. In such case, the non-contact image sensors may be attached on any portion of multi-needle sewing machine M that does not interfere with user activities during the sewing operation. Furthermore, by utilizing the incoming sensor signals from the image sensor, the movement amount of quilting fabric for each sewing cycle can be calculated with improved ease and accuracy. The use of CCD or CMOS image sensor allows reduction in size and cost of the detection sensor.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a sewing machine motor that vertically drives a sewing needle via a main shaft;

a sewing speed commander that produces a command sewing speed determined by rotational speed of the sewing machine motor;

a stitch-pitch specifier that specifies a stitch pitch to be applied to manually fed sewing operation;

a consumed thread amount detector that detects a consumed needle-thread amount in each ongoing sewing cycle; and a sewing speed controller that:

controls sewing speed at the command sewing speed when the command sewing speed is equal to or less than a predetermined constant reference sewing speed, and that controls sewing speed at a target sewing speed calculated based on the consumed needle-thread amount and the stitch pitch when the command sewing speed is greater than the reference sewing speed;

controls sewing speed at the reference sewing speed when the target sewing speed is equal to or less than the reference sewing speed; and controls sewing speed at the target sewing speed when the target sewing speed is greater than the reference sewing speed.

2. The sewing machine of claim 1, wherein when the command sewing speed is equal to or greater than the reference sewing speed and is equal to or less than a threshold speed greater than the reference sewing speed by a predetermined speed, the sewing speed controller corrects sewing speed to proximate the target sewing speed as magnitude of the command sewing speed in excess of the reference sewing speed increases.

3. A sewing machine, comprising:

a sewing machine motor that vertically drives a sewing needle via a main shaft;

a sewing speed commander that produces a command sewing speed determined by rotational speed of the sewing machine motor;

a stitch-pitch specifier that specifies a stitch pitch to be applied to manually fed sewing operation;

a movement amount detector that detects a manually fed cloth movement amount; and a sewing speed controller that:

controls sewing speed at the command sewing speed when the command sewing speed is equal to or less than a predetermined constant reference sewing speed, and that controls sewing speed at a target sewing speed calculated based on the cloth movement amount and the stitch pitch when the command sewing speed is greater than the reference sewing speed;

controls sewing speed at the reference sewing speed when the target sewing speed is equal to or less than the reference sewing speed; and controls sewing speed at the target sewing speed when the target sewing speed is greater than the reference sewing speed.

4. The sewing machine of claim 3, wherein when the command sewing speed is equal to or greater than the reference sewing speed and is equal to or less than a threshold speed greater than the reference sewing speed by a predetermined speed, the sewing speed controller corrects sewing speed to proximate the target sewing speed as magnitude of the command sewing speed in excess of the reference sewing speed increases.

5. The sewing machine of claim 3, wherein the movement amount detector comprises a non-contacting detection sensor that detects the manually fed cloth movement amount.

6. The sewing machine of claim 3, wherein the workpiece cloth is held by a cloth holder and the movement amount detector comprises a non-contacting detection sensor that detects movement amount of the cloth holder.

7. A computer readable medium for use in a sewing machine including a controller that controls the sewing machine, a sewing machine motor that vertically drives a sewing needle via a main shaft, a sewing speed commander that produces a command sewing speed determined by rotational speed of the sewing machine motor, the computer readable medium including a sewing machine motor control program, comprising:

instructions for specifying a stitch pitch to be applied to manually fed sewing operation;

instructions for detecting a consumed needle-thread amount in each ongoing sewing cycle; and instructions for controlling:

sewing speed at the command sewing speed when the command sewing speed is equal to or less than a predetermined constant reference sewing speed;

sewing speed at a target sewing speed calculated based on the consumed needle-thread amount and the stitch pitch when the command sewing speed is greater than the reference sewing speed;

sewing speed at the reference sewing speed when the target sewing speed is equal to or less than the reference sewing speed; and sewing speed at the target sewing speed when the target sewing speed is greater than the reference sewing speed.

8. The medium of claim 7, wherein when the command sewing speed is equal to or greater than the reference sewing speed and is equal to or less than a threshold speed greater than the reference sewing speed by a predetermined speed, sewing speed is corrected to proximate the target sewing speed as magnitude of the command sewing speed in excess of the reference sewing speed increases.

9. A computer readable medium for use in a sewing machine including a controller that controls the sewing machine, a sewing machine motor that vertically drives a sewing needle via a main shaft, a sewing speed commander that produces a command sewing speed determined by rotational speed of the sewing machine motor, the computer readable medium including a sewing machine motor control program, comprising:

instructions for specifying a stitch pitch to be applied to manually fed sewing operation;

instructions for detecting a manually fed cloth movement amount; and instructions for controlling:

sewing speed at the command sewing speed when the command sewing speed is equal to or less than a predetermined constant reference sewing speed;

sewing speed at a target sewing speed calculated based on the cloth movement amount and the stitch pitch when the command sewing speed is greater than the reference sewing speed;

sewing speed at the reference sewing speed when the target sewing speed is equal to or less than the reference sewing speed; and sewing speed at the target sewing speed when the target sewing speed is greater than the reference sewing speed.

10. The medium of claim 9, wherein when the command sewing speed is equal to or greater than the reference sewing speed and is equal to or less than a threshold speed greater than the reference sewing speed by a predetermined speed, sewing speed is corrected to proximate the target sewing speed as magnitude of the command sewing speed in excess of the reference sewing speed increases.

* * * * *